US009573728B2

(12) United States Patent
Jacobson et al.

(10) Patent No.: US 9,573,728 B2
(45) Date of Patent: Feb. 21, 2017

(54) BUCKET HOLDING AND TIPPING DEVICE

(71) Applicants: Jeffrey D. Jacobson, Seattle, WA (US); Jack M. Jacobson, Walla Walla, WA (US)

(72) Inventors: Jeffrey D. Jacobson, Seattle, WA (US); Jack M. Jacobson, Walla Walla, WA (US)

( * ) Notice: Subject to any disclaimer, the term of this patent is extended or adjusted under 35 U.S.C. 154(b) by 0 days.

(21) Appl. No.: 14/597,209

(22) Filed: Jan. 14, 2015

(65) Prior Publication Data

US 2015/0197373 A1 Jul. 16, 2015

Related U.S. Application Data

(60) Provisional application No. 61/964,780, filed on Jan. 14, 2014, provisional application No. 61/997,181, filed on May 23, 2014.

(51) Int. Cl.

| | |
|---|---|
| ***B65D 25/32*** | (2006.01) |
| ***B65D 25/28*** | (2006.01) |
| ***B44D 3/14*** | (2006.01) |

(52) U.S. Cl.

CPC ..... *B65D 25/32* (2013.01); *B65D 25/2808* (2013.01); *B65D 25/2841* (2013.01); *B44D 3/14* (2013.01)

(58) Field of Classification Search

CPC ... B44D 3/14; B65D 25/2805; B65D 25/2802; B65D 25/28; B65D 43/262; B65D 43/26; B65D 25/32; B65D 25/2808; B65D 25/2841

USPC ..... 220/752, 757, 756, 758, 904, 262, 694; 16/425, 422, 430; 248/145.6

See application file for complete search history.

(56) References Cited

U.S. PATENT DOCUMENTS

| | | | | | |
|---|---|---|---|---|---|
| 940,422 | A * | 11/1909 | Ballman | A47L 13/52 | 15/257.8 |
| 950,444 | A * | 2/1910 | Goeke | A47J 36/08 | 16/425 |
| 1,698,403 | A * | 1/1929 | Harris | B44D 3/14 | 16/425 |
| 2,236,187 | A * | 3/1941 | Walter | B44D 3/14 | 182/129 |
| 2,613,860 | A * | 10/1952 | Hoffman | B44D 3/14 | 220/23.4 |
| 7,399,017 | B1 * | 7/2008 | Lasseigne | A47J 47/18 | 16/425 |
| 7,651,060 | B2 * | 1/2010 | Roth | B01F 15/00733 | 248/146 |

* cited by examiner

*Primary Examiner* — Robert J Hicks
(74) *Attorney, Agent, or Firm* — Patrick M Dwyer

(57) ABSTRACT

A bucket holding and tipping device with an adjustably movable cinching band on which are engaged one or more foot plates. On each plate, the band passes through slots in the plates and the plates are adapted to receive in pressing relationship the bottom of a human foot. Each plate also has a handle opening in the plate.

10 Claims, 5 Drawing Sheets

BUCKET HOLDING AND TIPPING DEVICE

CROSS REFERENCE TO RELATED APPLICATIONS

This application claims priority to U.S. Provisional Patent applications 61/964,780 filed Jan. 14, 2014 and 61/997,181 filed May 23, 2014, each of which is hereby incorporated by this reference as if fully set forth herein.

TECHNICAL FIELD

This disclosure relates to devices for stabilizing buckets during mixing processes and for lifting and tipping buckets to pour out their contents; more particularly it relates to a bucket holding and tipping device.

BACKGROUND

Plastic buckets, and in particular the slightly tapered five gallon buckets sold at home improvement and construction supply stores, are commonly used for tipping and pouring a wide range of substances. In landscaping, for example, such buckets may be used for pouring out materials such as gravel, drain rock, mulch, and dirt. In the building trades buckets are often used to dispense construction materials. Buckets are frequently used for cleaning purposes, and excess cleaning fluids that remain in a bucket may require pouring off.

A bucket generally has a single handle located on a wire bail that swings from side to side on the bucket. When a bucket is filled or partially filled with materials, however, it can become heavy and difficult to control while tipping and pouring. Too much or too little material may be dispensed from the bucket, or the bucket may slip from the hand or hands of the user, potentially causing injury.

Many construction materials require mixing prior to use. These include mortar, grout, drywall joint compound, self-leveling compounds, and many other materials. The example bucket above is commonly used by tradespeople (sometimes also in the three gallon size) as a mixing vessel. Materials are typically mixed with a paddle bit attached to an electric drill.

However, mixing viscous substances in a bucket can be hazardous as the bucket tends to want to spin in the direction the mixing bit is turning A person may try to hold the bucket in place between his or her legs while mixing, or alternatively, set a foot on the rim of the bucket to stabilize it. Neither method provides a secure grip on the bucket and can permit the bucket to spin, and even to tip over, during mixing. This can lead to a waste of material and can potentially cause injury to the person.

There are a number of foot plate or foot pedal devices and foot stand devices known for use in holding cylindrical containers such as buckets and for securing a bucket in place during mixing. Nearly all of these devices are intended to secure a bucket during the mixing process only. See for example U.S. Pat. No. 7,651,060 to Roth. A bucket may be placed on, or in, the device, the device is engaged to secure the bucket, a substance is mixed in the bucket, and the bucket is removed from the device for use in the work area. Other such devices are typically bulky and must be carried to the work area separately from the mixing bucket.

There is one known device that provides an additional handle for buckets, disclosed in U.S. Pat. No. 7,399,017 to Lasseigne. It appears to be unnecessarily bulky and heavy, overly complex and expensive to manufacture. It also appears to be designed solely as a handle for the bottom of a bucket, and suggests no other locational or positional alternatives.

No known auxiliary handhold devices for cylindrical containers are also constructed for accepting a person's foot or feet to secure the bucket in place for mixing viscous materials, and none of the bucket hold-down devices provide handle functions for tipping, pouring, or carrying a bucket. There are no known handles that can be positioned wherever a users wants—at the bottom, top, or middle of a bucket.

DISCLOSURE

A device is disclosed for making it easier to tip and pour substances from a common plastic bucket and provide stability to the bucket when it is used as a mixing vessel. The device includes a handle that is secured to the bucket by an adjustable steel band or other cinching band means. The handle provides an auxiliary handhold for the bucket for improved user control when tipping or pouring from the bucket. The handle is constructed so that it also serves optionally, when so desired by the user, as a foot pedal or foot plate to help stabilize or secure the bucket in place during mixing.

The disclosed device is preferable over: 1) previous devices intended only to aid in tipping and pouring from a bucket; and 2) previous devices only for securing a bucket during mixing, because it combines an auxiliary handle and a bucket securing foot plate in a single, integrated, compact, and lightweight device.

Our device is also preferable because it: attaches securely to buckets having wide ranges of different outside diameters; enhances safe operation of mixing and tipping and pouring functions, even during vigorous use; stays attached to a bucket for convenience of use whenever either auxiliary function is needed; can be placed in most locations on a bucket's exterior, including, for example, around the middle of the bucket, to allow adjustment for the auxiliary handle function; can be easily customized according to user needs by adding one, two, or more combination handle/foot plates to provide, for example, two or more locations for auxiliary handles and/or foot plates; and is compact, lightweight, extremely durable, and inexpensive to manufacture. It readily has the capability for easy handle-location customization by users on the fly and in the work place by adding one, two, or more additional handholds and placing those handholds nearly anywhere a user needs them on a plastic bucket (to allow, for example, a person to carry a bucket using two auxiliary handles placed on opposite sides of a bucket, one in each hand). It is capable of attachment to buckets with a wide range of outside diameters while remaining firmly and safely in place on a bucket.

In one embodiment the components of the disclosed device are a one-piece handle and foot pedal component, a steel band with a common screw clamp or worm gear type adjustment mechanism attached to it. (For example, one end of the band has a screw pattern cut or pressed into it, the other end holds a captive screw.)

In another embodiment the components of the disclosed device are a one-piece handle and foot pedal component, a one-piece attachment plate, and screws or the like for bonding the handle and foot component to the attachment plate.

In another embodiment the components of the disclosed device are a hinged component consisting of a pivoting member and a stationary member, a steel band with a common screw clamp or worm gear type adjustment mechanism attached to it (for example, one end of the band has a screw pattern cut or pressed into it, the other end holds a captive screw), and a steel torsion spring.

The disclosed bucket holding and tipping device includes a system of one or more movable combination handle/foot plates on a cinching band such as the adjustable steel band disclosed herein. Other cinching bands will be known to those skilled in the art. A cinching band is used to provide sufficient compression of a plastic bucket, even at its relatively sturdier bottom end, so that the band and its attached handle/foot plate units will not slip either vertically or circumferentially, once the band is tightened. A cinching band generally does not include any bottom structure, such as is employed in some known devices to actually engage and hold to the bottom surfaces of a bucket. Rather, the cinching band is attachable to the bucket along any of its outer and circumferential surface, and not limited to either top or bottom locations on the bucket. The cinching band is immediately and easily movable, as indicated, as soon as the tension on the band is released and the band no longer compresses the bucket.

By combination is meant a one-piece or unitary combination construction that serves, at need, as either handle or foot plate (foot pedal) or both. Each handle/foot plate combination has a foot pedal portion and a handle portion, and the handle portion is defined at least in part by an opening in the handle/foot plate piece. The opening may be entirely enclosed (see FIGS. 1 and 5) or partially enclosed (see FIG. 14).

The handle portion may look like a ring or drawer handle within, or projecting from, the handle/foot plate piece, or it may be a T-type handle or the like (such as a drawer pull), projecting and extending from the handle/foot plate piece, or projecting to some degree out of the plane of the handle/foot plate piece (see FIG. 14). In the latter case, the handle opening is only partially enclosed, and for a T-type handle, there are two such openings. In general the opening is suitable for receiving some or all of the fingers of a user's hand and, in conjunction with the material of the handle/foot plate piece that surrounds the opening, to perform all of the functions of a handle, as will be appreciated by those skilled in the art.

An alternative for the handle opening is to be formed by a full or partial curvature of a portion of the material of the handle/foot plate piece. For instance, an otherwise generally planar handle/foot plate piece is bent at its outermost (away from the bucket) end, at least to the extent necessary to make it a gripping surface independent of the rest of the (unbent) handle/foot plate piece. The space between the planar or generally flat portion of the piece and the curved or bent portion of the piece is the 'opening' for the handle, in this example.

The combination handle/foot plate is movable on the band in degrees around a circumference of the bucket, such that a single combination unit may be placed directly below or diametrically opposite the conventional bail-style bucket handle roller, or indeed, anywhere around the circumference of the bucket. Where there are more than one combination unit attached to the bucket on a single band, they may be spaced any useful number of degrees apart. For instance two such combination units may oppose one another or be spaced 60 to 90 degrees apart (or the like, or somewhere in between) to accommodate the foot pattern of the user in holding the bucket securely with both feet.

The disclosed device allows the system of one or more movable combination handle/foot plates on a cinching band to be movable up and down a height of the bucket, anywhere from top to bottom or in between, again depending on user preferences.

Alternatively, the disclosed device may also employ a fixed combination handle/foot plate, either singly or in combination with movable combination units on one or more cinching bands. The fixed unit is generally screwed or otherwise affixed to the exterior of the bucket.

An alternate embodiment of the disclosed bucket holding and tipping device has two (or more) movable cinching bands: a first movable combination handle/foot plate on a first cinching band and a second movable combination handle/foot plate on a second cinching band. Either or both of the cinching bands are selectably movable up and down a height of the bucket, from top to bottom.

DETAILED DESCRIPTION

Figure 1:
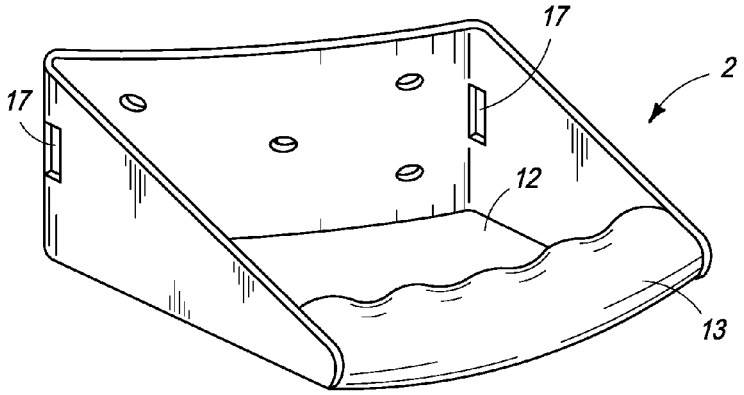
FIG. 1 is a perspective view of a component of the device.
Figure 2:
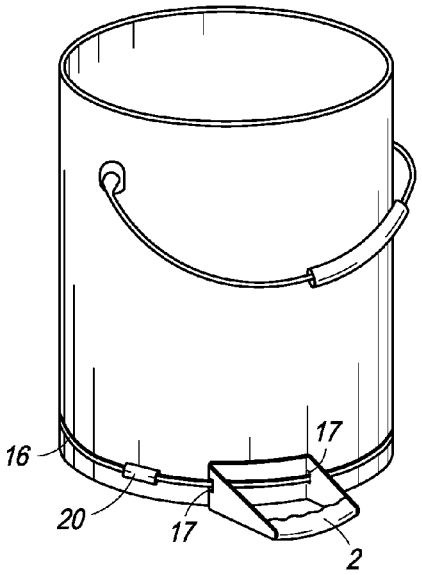
FIG. 2 is a perspective view of the device attached to a bucket.
Figure 3:
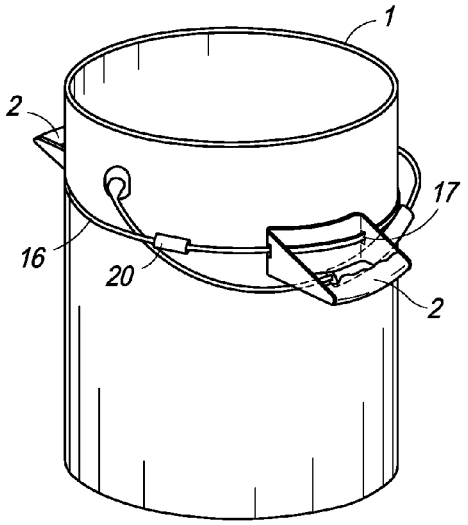
FIG. 3 is a perspective view of the device attached to the bucket in an alternate configuration.

In FIGS. 1-3 a one-piece handle and foot pedal component 2 has slots 17 through which cinching band 16 (such as adjustable steel) passes to attach component 2 to bucket 1. Conventional screw clamp mechanism 20 is mounted to cinching band 16 for tightening or loosening the band on bucket 1. Component 2 has handle portion (opening) 12 and pedal portion 13.

FIGS. 2 and 3 illustrate schematically the variety of positions and arrangements of cinching band 16 and handle and foot pedal component 2 (or alternate T-shaped pedal/handle). There may be multiple bands spaced vertically on the bucket, each band holding one or more (combination) handle and foot pedal components (as the combination of FIGS. 2 and 3 suggest, one high, one low). This variety of position and arrangement ranges from one combination handle/foot pedal cinched low on the bucket to two or more cinched high on the bucket, with combinations and single arrangements everywhere in between.

Figure 4:
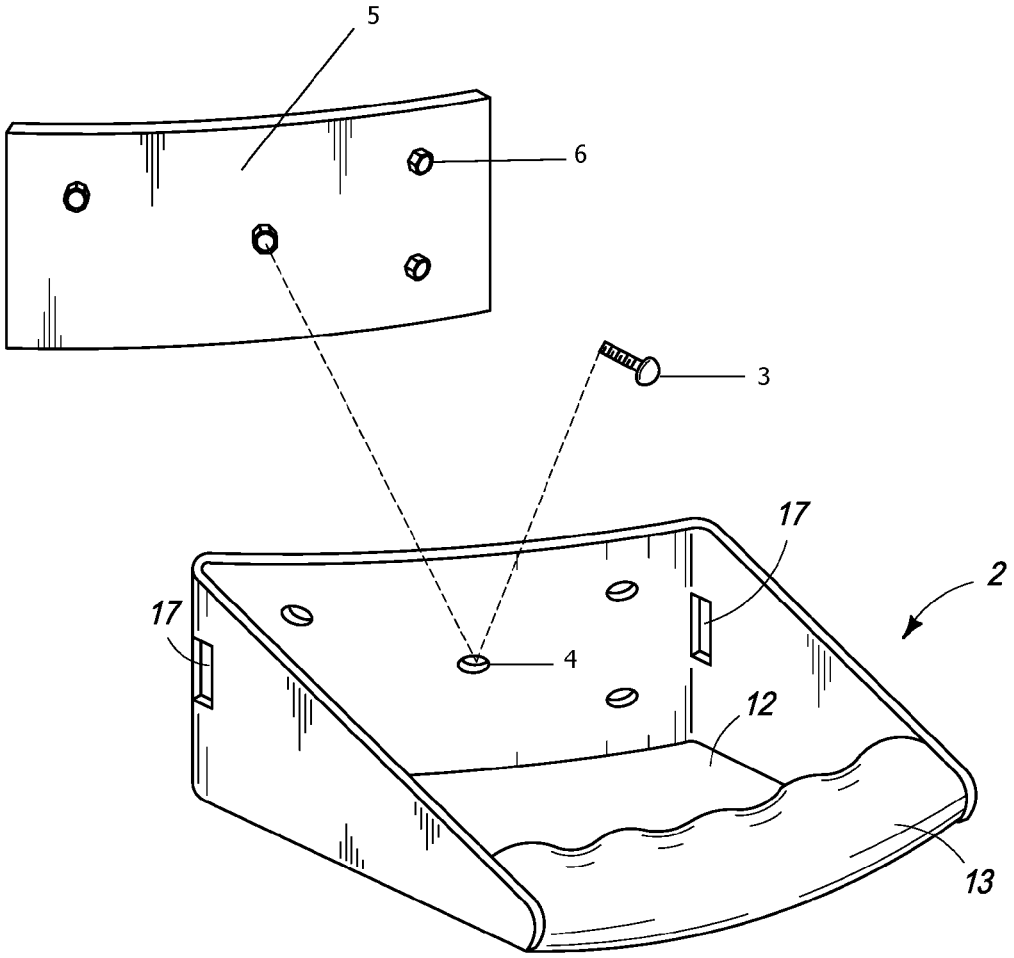
FIG. 4 is a perspective view of the device showing an alternate means of attachment to a bucket.

In FIG. 4, handle and foot pedal component 2 is attached to bucket 1 by screws 3 that pass through holes 4 in component 2 and into attachment plate 5 that is placed inside bucket 1. Attachment plate 5 has reinforced elevated elements 6 on the surface of the attachment plate where the screws attach to increase the holding power of the screws and ensure a stronger bond of component 2 to the bucket.

FIGS. 5-9, a hinged pedal has pivoting member 10 and fixed member 11. Pivoting member 10 has handle opening 12 and raised lines in the form of inverted grooves on pedal 13 to enhance friction and grip when pivoting member 10 is used as a foot pedal. Adjustable steel band 16 passes through slots 14 in fixed member 11 in order to attach the hinged pedal to a bucket. A screw clamp mechanism is mounted to the steel band for tightening or loosening band 16 on the bucket.

Figure 5:
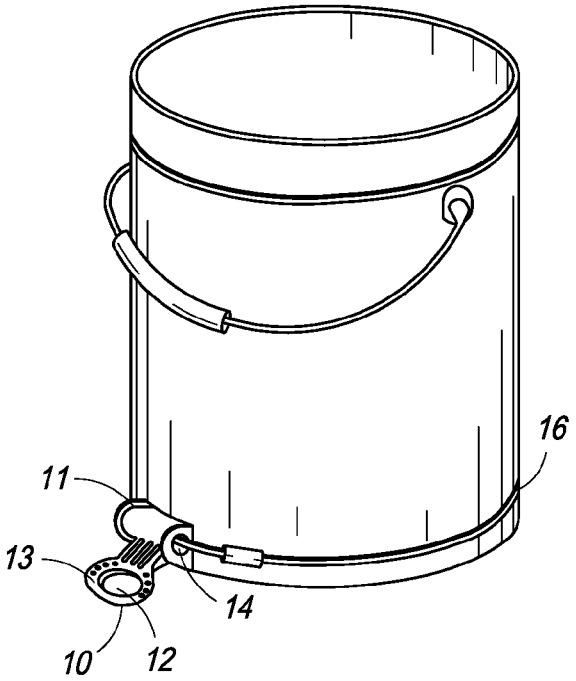
FIG. 5 is a perspective view of the device in a horizontal position attached to the bucket.
Figure 6:
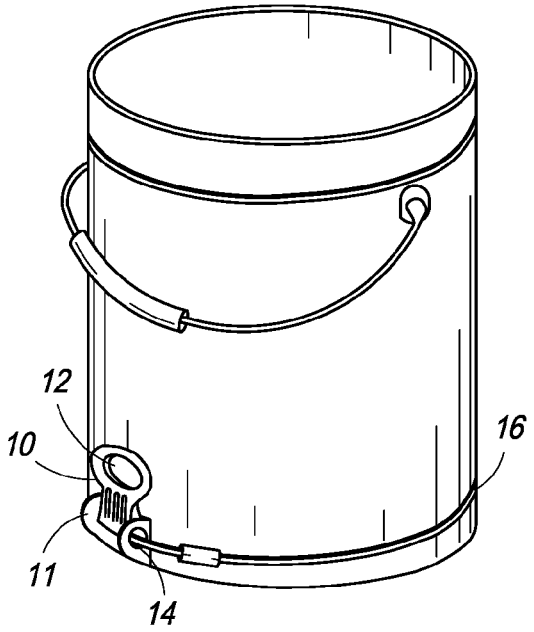
FIG. 6 is a perspective view of the device in a vertical (or up) position on the bucket.
Figure 7:
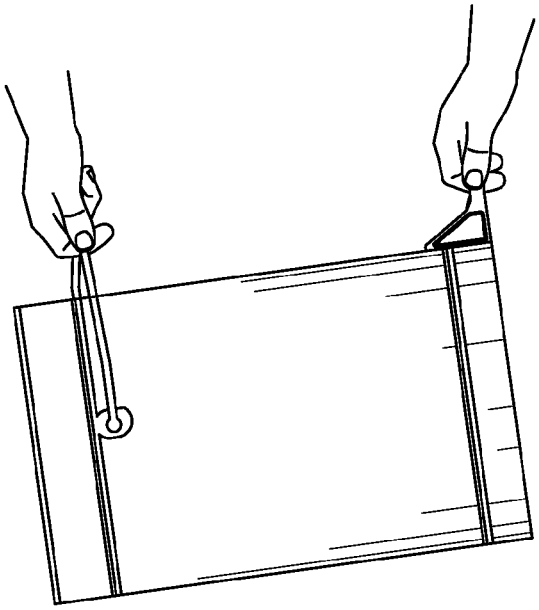
FIG. 7 is a side view of the device's auxiliary handle function being engaged to tip the bucket.
Figure 8:
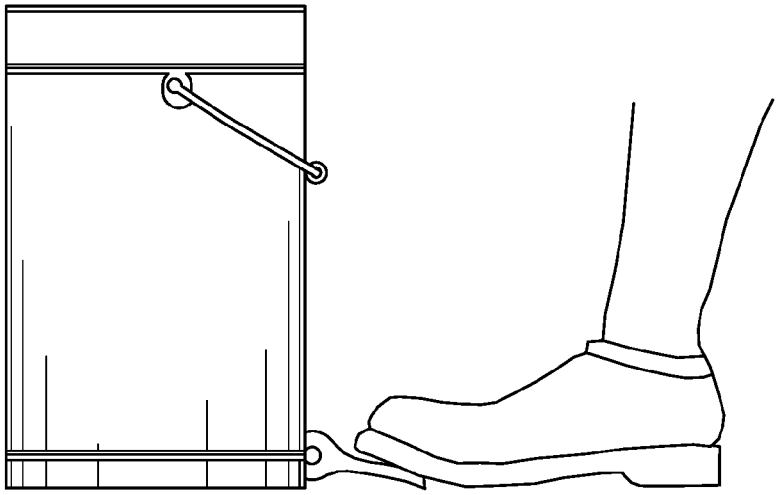
FIG. 8 is a side view of the device's foot lever being engaged to secure, or hold down, the bucket.
Figure 9:
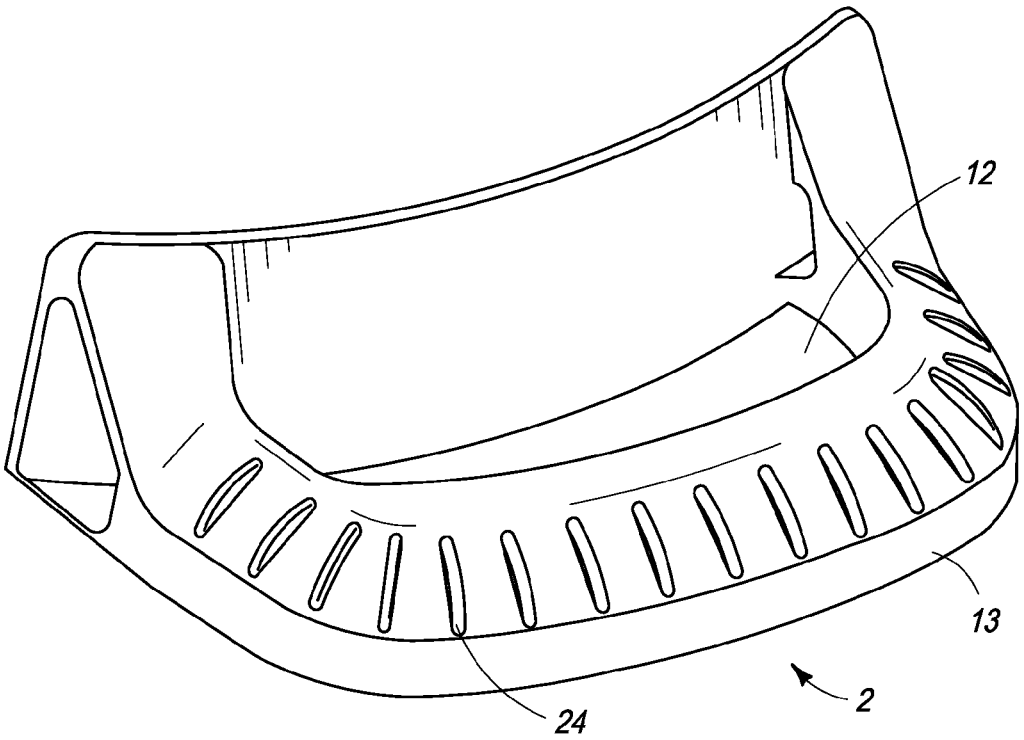
FIG. 9 schematically illustrates a traction detail for a foot pedal gripping surface.

FIGS. 5 and 8 show pedal in down position for when pedal is in use to stabilize bucket 1. FIG. 9 illustrates an alternate traction detail 24 for foot pedal 13.

There are many alternative embodiments for the disclosed holding and tipping device. Handle and foot pedal component 2 shown in FIGS. 1-4, may be made of any suitably rigid material, including plastic, metal, rubber, wood, or a combination of these materials; the component may be molded or formed as a unitary piece or it may be bonded together using fasteners or other bonding agents. The disclosed device may take a variety of forms including a T-shape, a cutout or cutouts in the form of one or more finger loop or loops, a curved, scooped, or hollowed-out form to provide a gripping surface without a cutout, among many other variations.

Handle and foot pedal component 2 shown in FIG. 4 may be attached to a bucket using two or more screws or other fasteners, a bonding agent such as glue or tape, or by a combination of screws/fasteners and a bonding agent. The disclosed device may omit the use an attachment plate in a bucket's interior if a bonding agent such as glue or tape is used without the use of screws or other fasteners. One-piece attachment plate 5 (FIG. 4) may be composed instead of two or more smaller plates. The attachment plate may use washers, O-rings, or similar components to prevent leakage through holes formed in a bucket and through which the screws or fasteners pass. The hinged pedal may be made of any suitably rigid material, including plastic, metal, rubber, wood, or a combination of these materials. In lieu of steel band 16, handle and foot pedal component 2 or the hinged pedal 13 may be attached to the bucket with other suitably stretch-resistant materials including nylon or plastic banding, webbing, or cording.

Alternate clamping elements for the handle and foot pedal component or the hinged component include conventional ratcheting mechanisms and various conventional latches including toggle-hook, draw, and compression latches.

The hinge mechanism may also take many different forms; for example, it may pivot on a single pin, similar to a common door hinge, or it may use two or more pins or two or more pin-type structures that include rivets and screws. Many different configurations of the torsion spring, which provides the spring-loaded functionality for the lever, are possible, and generally include any configuration that leverages the power of a coiled spring to return the lever to an upright position on a bucket. In lieu of a torsion spring, the pivoting member may be held in an upright position on the bucket in a variety of other ways, for example, by tooth or tine on the arm or arms of the pivoting member that fits into a notch or notches in the rounded cutout or cutouts of the fixed member that are aligned in such a way as to "lock" the hinged component in an upright position.

In compliance with the statute, the invention has been described in language more or less specific as to structural features. It is to be understood, however, that the invention is not limited to the specific features shown, since the means and construction shown comprise preferred forms of putting the invention into effect. The invention is, therefore, claimed in any of its forms or modifications within the legitimate and valid scope of the appended claims, appropriately interpreted in accordance with the doctrine of equivalents.

We claim:

1. A bucket holding and tipping device comprising an adjustably movable cinching band having a circumference on which are engaged one or more handle/foot plates, the band passing through slots in the plates, the plates adapted to receive in pressing relationship the bottom of a human foot, each plate further comprising a handle opening in the plate.

2. The device of claim 1 where the handle/foot plate is movable on the band in degrees around the circumference of the band.

3. The device of claim 1 where the handle/foot plates on the cinching band are movable up and down on a bucket.

4. The device of claim 3 wherein the number of handle/foot plates on the cinching band is two or more.

5. The device of claim 1 wherein the number of handle/foot plates on the cinching band is two or more.

6. The device of claim 1 further comprising a fixed combination handle/foot plate.

7. A bucket holding and. tipping device comprising a first movable cinching band and a second movable cinching band, each hand having engaged therewith its own handle/foot plate, each respective hand passing through slots in the respective plates, the plates adapted to receive in pressing relationship the bottom of a human foot, each plate further comprising a handle opening in the plate.

8. The device of claim 7 wherein either or both of the cinching bands are selectably movable up and down.

9. The device of claim 7 wherein the number of movable combination handle/foot plates on either or both cinching bands two or more.

10. The device of claim 7 further comprising a fixed combination handle/foot plate.

* * * * *